US005913532A

United States Patent [19]

Viodet et al.

[11] Patent Number: 5,913,532

[45] Date of Patent: Jun. 22, 1999

[54] SKI BINDING

[75] Inventors: Patrice Viodet, La Fermete; Michel Thevenet, Coulanges les Nevers, both of France

[73] Assignee: Look Fixations SA, Nevers, France

[21] Appl. No.: 08/768,651

[22] Filed: Dec. 18, 1996

[51] Int. Cl.[6] ..... A63C 9/10

[52] U.S. Cl. ..... 280/633

[58] Field of Search ..... 280/631, 632, 280/633

[56] References Cited

U.S. PATENT DOCUMENTS 4,620,719 11/1986 Strizl ..... 280/633

*Primary Examiner*—Robert J. Oberleitner

*Assistant Examiner*—Robert J. McCarry, Jr.

*Attorney, Agent, or Firm*—Fay, Sharpe, Beall, Fagan, Minnich & McKee, LLP

[57] ABSTRACT

A ski binding (1) is longitudinally positionable (PL) in relation to a runner (10) which is fixed to a ski (9). A lock (14) is moveable from a locked position (V1, FIG. 1) to an unlocked position (V2, FIG. 2) for selectively fixing and releasing the binding for longitudinal movement. A lever (26) cooperates with the lock to provide an upward thrust for unlocking the lock. The lever (26) extends rearwardly between side walls (320*a*, 320*b*) of a hollow housing (32).

20 Claims, 5 Drawing Sheets

SKI BINDING

BACKGROUND OF THE INVENTION

The present invention concerns a device for restraining a boot to a ski, generally referred to as a ski binding. More particularly, the invention concerns an improvement to the binding's adjustment means for longitudinal and locking positions, as chosen, on the ski or the like.

Generally, the boot of the skier is held onto the ski in a releasable manner by its front end due to a front binding, commonly referred to as a "toe-piece" binding, and by its back end and particularly its heel due to a back binding, commonly called a "tail" binding. In the event of significant pressure endangering the leg or joints of the skier, the release of the ski boot is done by the front, by the heel of the boot, or by both of them at once. In this manner, the front toe-piece binding includes, for example, a jaw pivoting laterally around a vertical axle, while the tail binding generally includes a jaw pivoting toward the top around a transverse axle, the jaw of the toe-piece binding and that of the tail binding each being prompted by a releasing spring whose compression is adjustable to assure a skier a pressure limit for the release of his ski boot.

The numerous bindings which include means of adjusting the binding's longitudinal position on the ski are well-known. Thus, front toe-piece bindings and back tail bindings which are positionally adjustable on the ski in a way to adapt the distance between the front toe-piece binding and the tail binding to the length of the boot are already known. As a general rule, it is the tail binding which is moved, which includes a sliding body on a runner, immovable in the chosen longitudinal position due to a locking device which includes a lock which is movable between two positions, a locked position and an unlocked position which permits the user to move his binding along the longitudinal axle of the ski in a such a way as to position the binding in a longitudinal position determined by and adapted to the length of the boot.

Such bindings, for example, are described in French patents or patent applications published under the numbers 2,747,626 and 2,614,545.

In the binding of French patent no. 2,747,626, a device is anticipated for adjustment of the binding in longitudinal position, constituted by a lock prompted by a spring whose back part is extended to constitute a prehension part which is manually accessible to the user. This solution, which allows the user to be able to manually carry out the adjustment without the aid of a particular tool does not always result in total satisfaction. In effect, unlocking of the lock can occur accidentally in an untimely manner, for example, by accidentally bumping the prehension part which juts out from the body. Moreover, the extension of the lock is not sufficiently long for the significant pressure which the user must exert, and the user will therefore have a difficult time causing the upthrust of the lock.

In the binding of French patent no. 2,614,545, the user cannot manually act on the lock. One can easily understand the inconvenience of such a device which requires the user to use a specific tool. In the absence of this tool, the user will find that operating the adjustment is impossible.

The present invention therefore seeks to resolve the inconveniences of previous systems in suggesting a binding whose apparatus for adjusting longitudinal position is manually operated without requiring the use of a particular tool, without requiring the user to exert significant pressure, and without any risk of untimely unlocking.

SUMMARY OF THE INVENTION

Thus, the invention concerns a ski binding whose longitudinal position is adjustable in relation to the ski, including a movable body sliding on a runner which is fixed to the ski and the locking means permitting the user to be able to lock the said body in a longitudinal position determined by the relation to the ski, the said locking means being constituted by a lock movable from a locked position to an unlocked position, characterized in that it includes an operation lever detached from the lock, which cooperates with the lock in a way in which the upthrust of the operation lever causes the movement of the lock from its locked position to its unlocked position, and in a way in which the operation lever extends towards the rear of the hollow housing which is achieved in the back part of the body. Note that the operation lever is advantageously a lever of the second type which has a point of cooperation with the back part in a same section or portion of the lever as a point of prehension or gripping of the lever.

According to an additional characteristic, the hollow housing is open at the back and is limited laterally by the two side walls of the body, the depth of the hollow housing being such that the operation lever and more particularly its prehension or gripping branch does not project outside of the back section of the body so as to be totally sheltered inside the housing, at least in its locked position. Additionally, the hollow housing is such that the operation lever is also sheltered by the side walls in its unlocked position.

According to another characteristic of the invention, the operation lever, which includes the means of cooperating with the lock, is pivotally on the body of the binding around a pivotal axle which is situated in the lower part of the body of the binding.

According to an additional characteristic, the pivotal axle of the operation lever is situated under the horizontal surface of the elastic system.

In a preferred mode of operation, the pivotal axle of the operation lever is situated under the lock, and more particularly under the back end part of the lock.

According to another additional characteristic, the pivotal axle of the operation lever is situated approximately at the level of the horizontal surface going through the pivotal axle of the lock, while, in a preferred mode of operation, it is situated slightly above the horizontal surface going through the pivotal axle of the lock.

Additionally, the means of cooperation defines a point of cooperation with the lock which advantageously is such that the distance between the said point of cooperation and the pivotal axle of the operation lever is less than the distance between the point of manual prehension of the operation lever and the said pivotal axle, while the pivotal axle of the operation lever and the point of cooperation are situated approximately at the level of the horizontal surface going through the pivotal axle of the lock.

Note that the lock is advantageously constituted by a metal section which includes a front end while its back end is folded toward the top by a vertical part extended by its back end part which is folded to extend approximately horizontally toward the back, while the central part of the lock includes a series of lateral teeth whereas the runner includes a corresponding series of teeth. Understandably, the lock could only include one tooth intended to cooperate with one corresponding series of teeth achieved in the runner, the said lock including therefore at least one tooth.

More precisely, according to the method of achievement given as an example, the lock is prompted into the locked position by an elastic system, while the pivoting operation lever is constituted by a metal piece which has the form of a stirrup in the shape of a "U" open at the bottom in order to include two sides connected by their back ends by a transverse branch of prehension. Also note that the lateral sides extend approximately horizontally from their jointed part to the transverse branch of prehension.

BRIEF DESCRIPTION OF THE DRAWINGS

Other characteristics and advantages of the invention will become apparent from the description which follows with regard to the attached drawings which are given only as example and not for limitation.

FIG. 1 shows the binding in its locked longitudinal position.

FIG. 2 shows the binding in its releasing position of the boot and in unlocked longitudinal position permitting its movement longitudinally in relation to the ski.

FIG. 3 shows the binding in its locked longitudinal position.

FIG. 4 shows the binding in its unlocked position permitting its longitudinal movement.

DETAILED DESCRIPTION OF THE PREFERRED EMBODIMENTS

Figure 1:
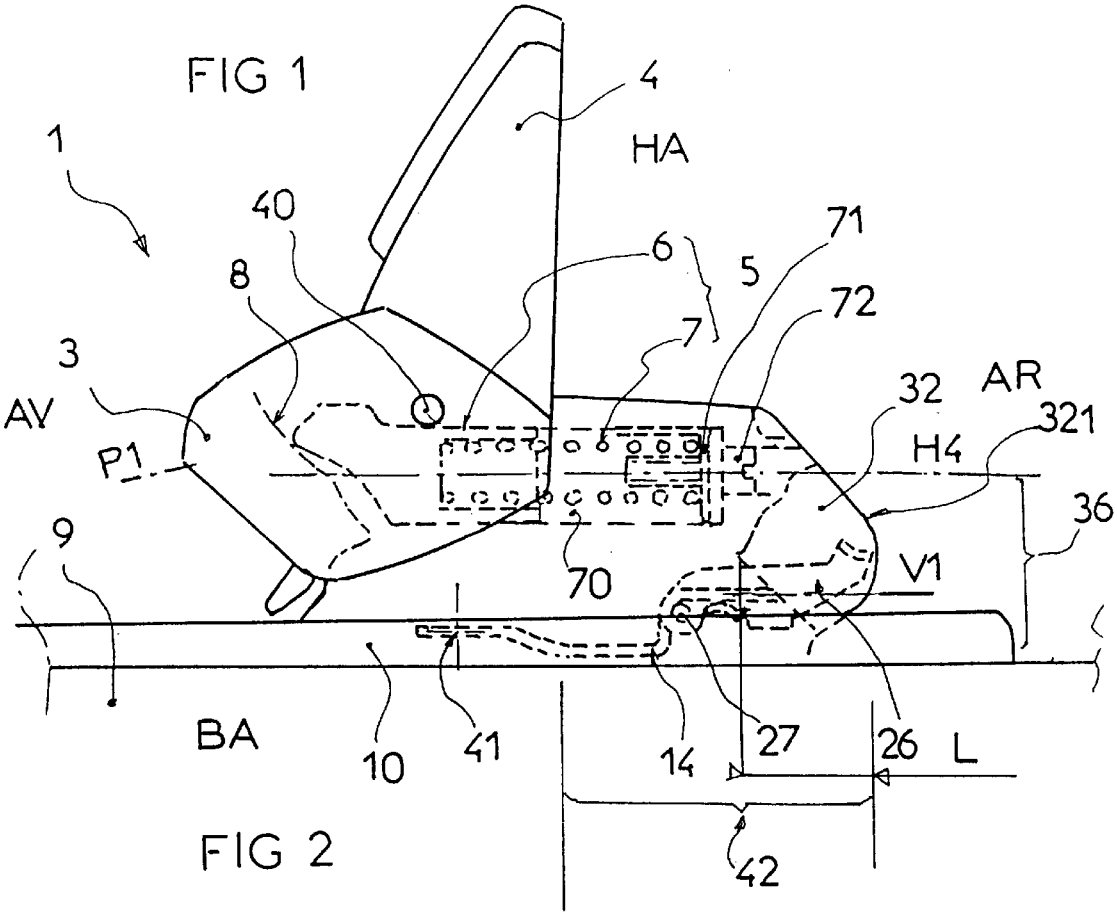
FIGS. 1 and 2 are exterior views of a binding according to the invention.

The binding, shown by examples, equipped with the adjustment apparatus of the invention is a binding intended to restrain the heel of a boot. This binding is, for example, a tail binding 1 which includes a body 2, of vertical plane of general symmetry (P), on which is articulated around a transverse axle 40, on one hand, a pivoting restraining jaw 3 and, on the other hand, a pivoting release lever 4.

In a well-known manner, the jaw 3 is therefore pivotal on the body in order to be pivotally movable from a position in which it holds the boot (P1) to a release position (P2), and vice versa. Furthermore, the jaw 3 is prompted into restraining position of the boot (P1) by the action of an elastic system 5 which is constituted by a movable locking system 6 which is prompted by a spring 7 on a release ramp 8, which is achieved in the interior of the jaw 3.

Figure 2:
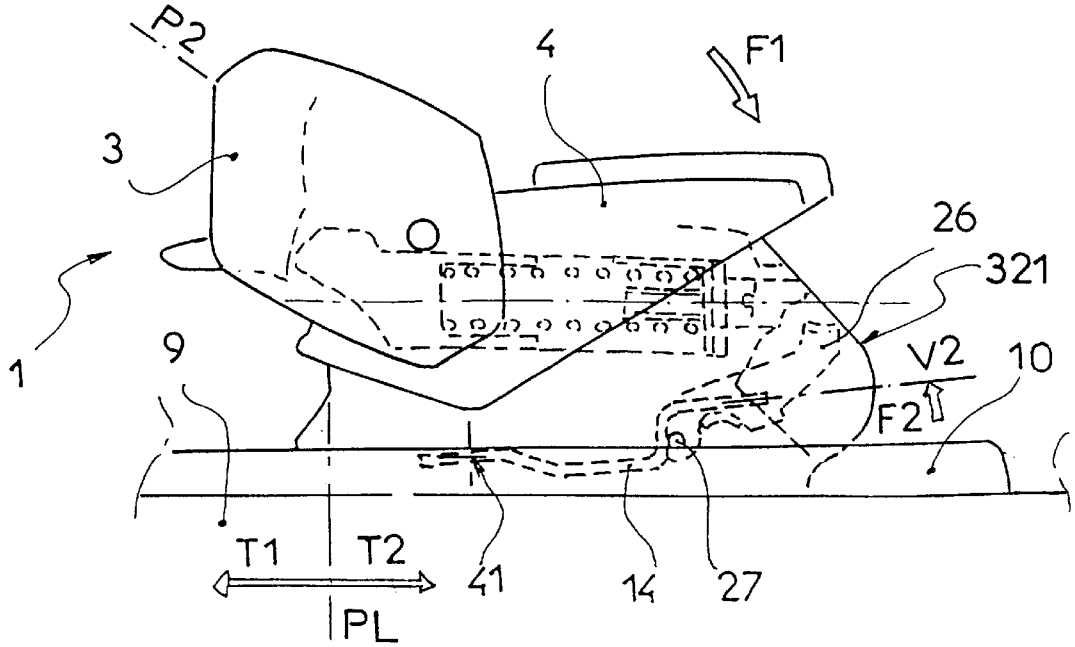

The release lever 4 permits the user to be able to release his boot by pivoting the jaw from its restraining position (P1) to its release position (P2). Thus, in the restraining position of the jaw, the said lever extends toward the top (HA), such as illustrated in FIG. 1, in order to be able to be pivoted towards the rear (AR) and towards the base according to FIG. 1, in order to force open the jaw, such as is shown in FIG. 2.

The movable body 2 of the binding is longitudinally transferred (T1, T2) along the ski 9. In this way, the said body 2 is slidably mounted on a runner 10, fixed to the ski 9. The latter 10 is constituted by a metal plate longitudinally extended and including two lateral restraining and sliding parts for the body 11*a*, 11*b*, achieved by the curved conformation of the side edges 12*a*, 12*b* of the metal plate. Moreover, the body 2 of the binding includes laterally and at its base two sliding rims 13*a*, 13*b* intended to be engaged with the lateral restraining and sliding parts 11*a*, 11*b* of the runner 10. Thus, the body 2 is held towards the top by the runner, so as to be able to be moved longitudinally (T1, T2).

Moreover, the locking means permitting the user to be able to lock the body 2 of the binding in a longitudinal position (PL) which is determined by the body's relation to the runner 10 is anticipated.

The locking means are constituted by a movable lock 14 which cooperates with the runner 10. In this way, the central part 34 of the lock 14 includes a series of lateral teeth 15*a*, 15*b*, while the horizontal surface 12*c* of the runner 10 includes a corresponding series of teeth 16*a*, 16*b*.

Figure 3:
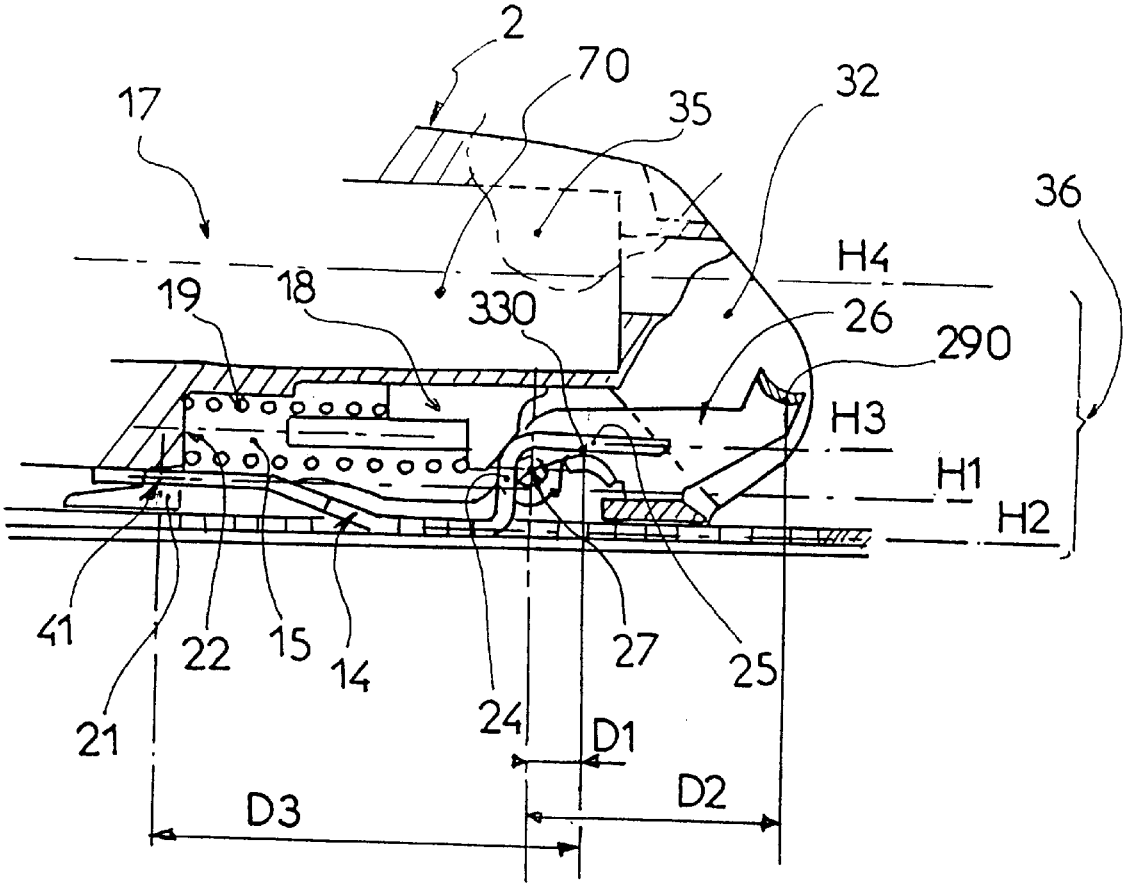
FIGS. 3 and 4 are large scale partial views in longitudinal cross-section.
Figure 4:
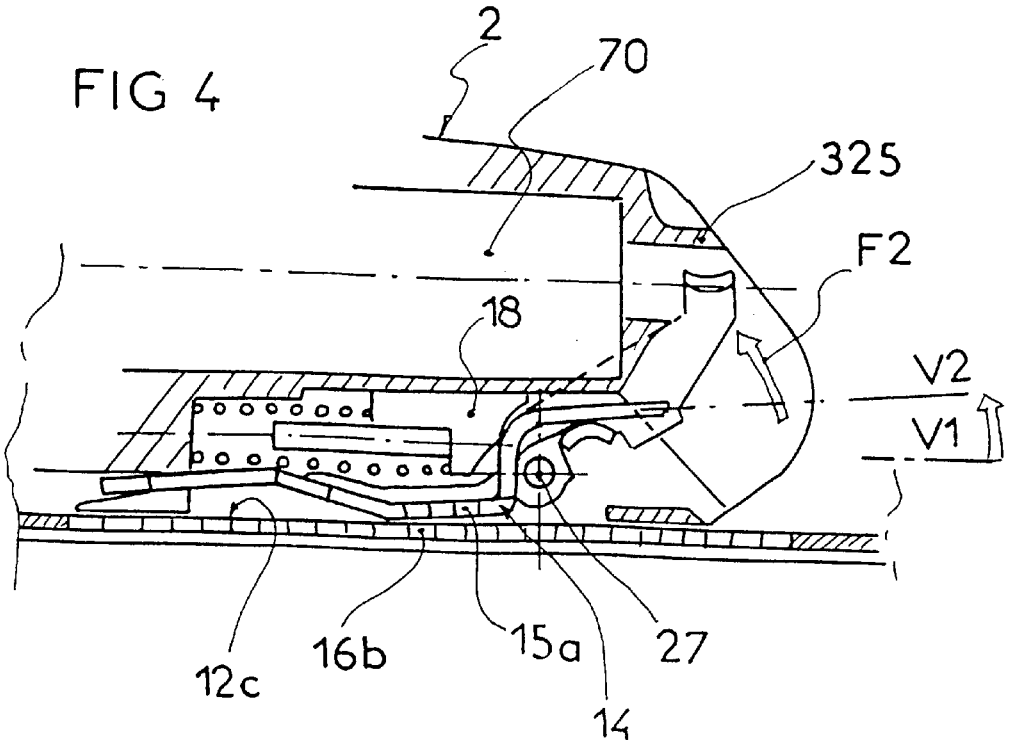
Figure 5:
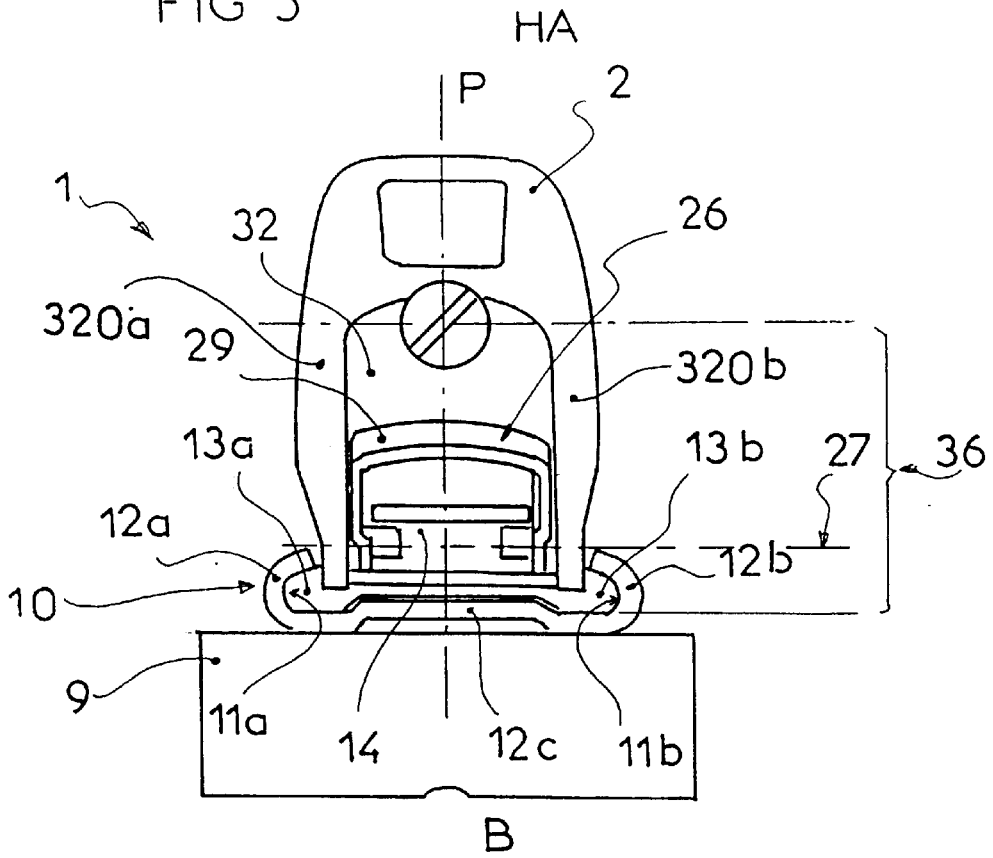
FIGS. 5 and 6 are end views of the two preceding figures respectively (FIG. 3 and FIG. 4).
Figure 6:
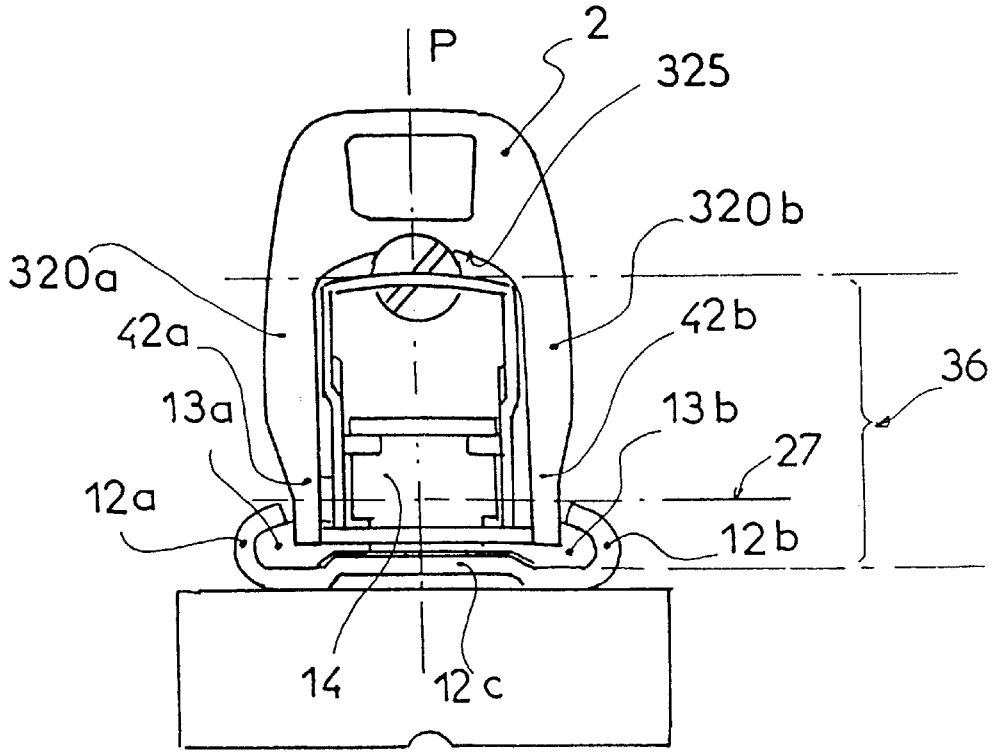
Figure 7:
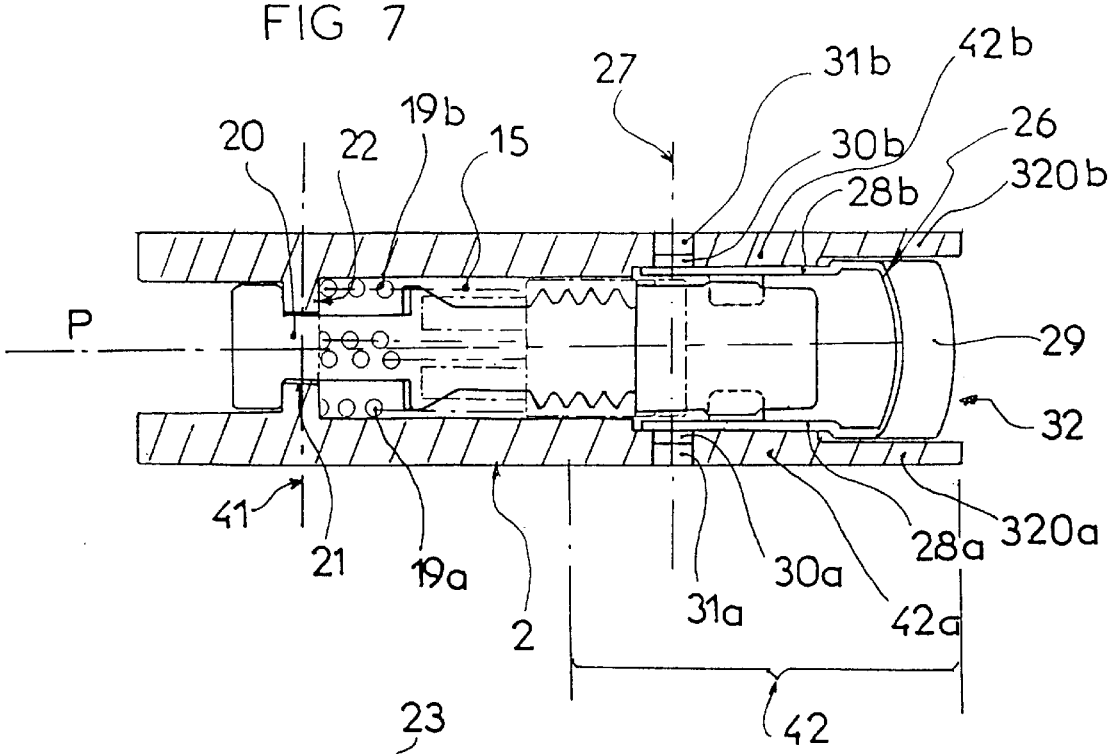
FIG. 7 is a top view in horizontal cross-section of the body, showing more particularly a top view of the locking means.
Figure 8:
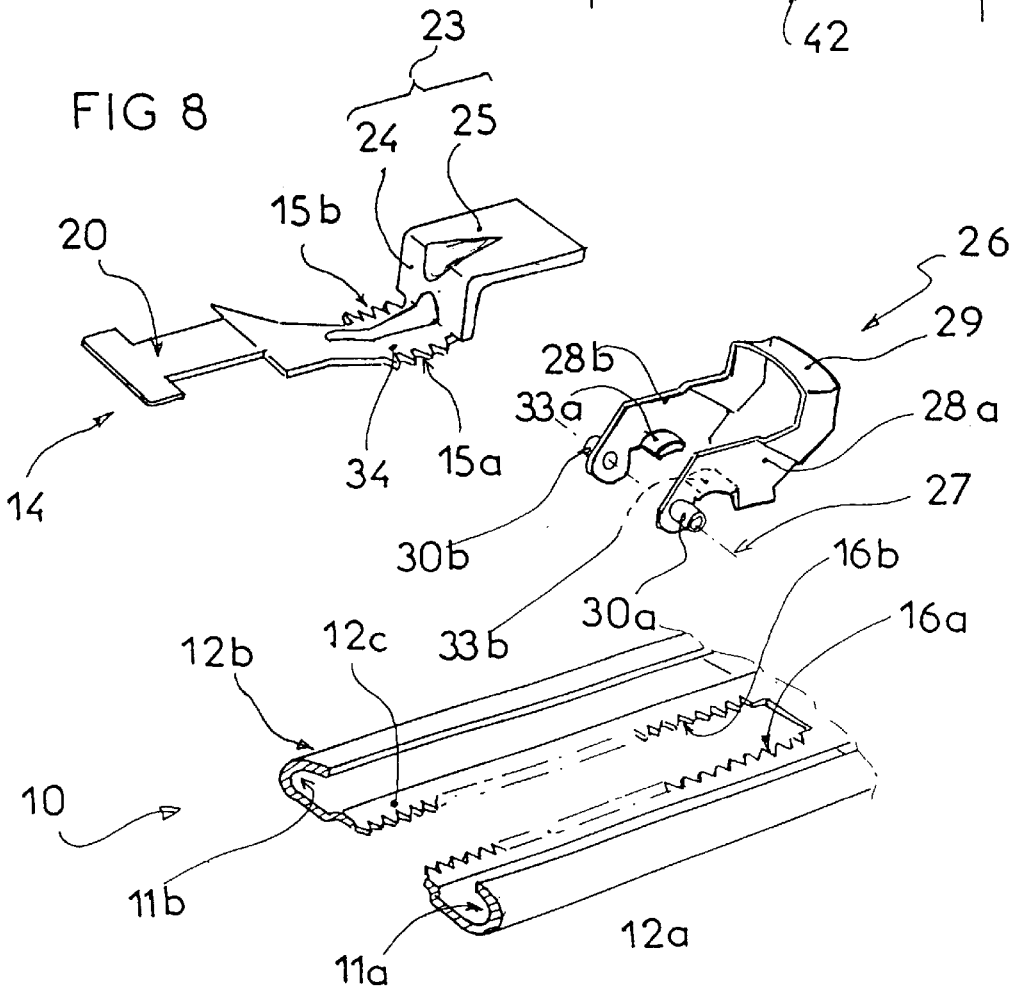
FIG. 8 is a perspective view illustrating the different pieces which constitute the adjustment means and the locking of the binding in fragmented state.

The lock 14 is constituted by a metal section extending longitudinally in order to be housed in the lower housing 15 which is achieved in the body 2 of the binding, the said housing being open at the base (BA) and at the back (AR). In this housing, the lock 14 is pivotally movable in order to be set in two positions, namely, a locked position (V1), such as is illustrated in FIGS. 1, 3, and 5, according to which the series of teeth 15*a*, 15*b* of the lock 14 cooperates and engages with the corresponding series of teeth 16*a*, 16*b* which is achieved in the runner 10, and an unlocked position (V2), such as is shown in FIGS. 2, 4, 6, according to which the lock is raised until disengagement of the series of teeth of the lock from those corresponding teeth of the runner. In the unlocked position of the lock (V2), one will understand that the body 2 can be moved freely forwards (T1) or backwards (T2) in order to go from one longitudinal position (PL) to another longitudinal position.

The lock 14 is prompted toward the base into a locked position by the action of an elastic system 17 which is constituted by a sliding activating piece 18 which is prompted by a spring 19. Note that the longitudinal section constituting the lock 14 includes a front end 20 in the shape of a "T" which is engaged in a groove 21 achieved on the front surface 22 of the inner housing 15, while its back end 23 is folded towards the top by a vertical part 24 which is extended by a back end part 25, which is folded in order to extend approximately horizontally towards the back (AR). The sliding activating piece 18 acts on the lock 14 by contact, for example, on the vertical part 24 of the end of the lock 14. The unlocking of the lock 14 is accomplished by the upthrust of the back end 23 of the longitudinal piece toward the top according to F2 around a front pivotal axle 41 by pivoting towards the top against the action of the spring of the elastic system 17, constituted by two parallel springs 19*a*, 19*b* in the example of achievement.

The upthrust of the lock 14 is advantageously accomplished manually by the middle of a pivoting operation lever 26 which is constituted by a pivoting lever pivotally mounted on the body of the binding around a pivotal axle 27. The pivoting operation lever 26 is constituted by a metal piece generally having the form of a stirrup in the shape of a "U" open at the bottom. Thus, it includes two lateral sides 28*a*, 28*b*, connected by their back ends by a transverse prehension branch 29. The front ends of each lateral side 28*a*, 28*b* include a cylindrical projection 30*a*, 30*b* which extend transversely towards the exterior and are intended to engage in the corresponding holes 31*a*, 31*b* of the side walls

42*a*, 42*b* of the body 2 to constitute the pivotal axle 27 for the operation lever. Note that the stirrup constituting the operation lever extends backwards (AR) to make a projection and, more particularly, its branch of prehension or gripping 29 with the back ends of the lateral sides 28*a*, 28*b* in a central rear housing 32 which is achieved in the back part 35 of the body 2, the said central rear housing 32 being intended for the passage of the branch of prehension 29. One will note that the central rear housing 32 is a hollow housing achieved in the body which is open at the rear and is limited laterally by the two side walls 320*a*, 320*b* of the body 2. The depth (L) of the hollow housing 32 is such that the operation lever 26 and, more particularly, its branch of prehension 29 does not project outside the back part 321 of the body in such a way as to be completely protected inside the housing at least in the locked position. The hollow housing 32 is also advantageously such that the operation lever, and more particularly its branch of prehension 29, is protected not only in its locked position (FIG. 1) but also in its other positions, such as its unlocked position (FIG. 2).

According to the invention, the operation lever 26 cooperates with the lock 14 such that its upthrust causes the movement of the lock 14 from its locked position (V1) to its unlocked position (V2). In other words, the upthrust of the operation lever 26 causes the upthrust according to F2 of the said lock 14 and thus its unlocking by disengagement of the series of teeth 15*a*, 15*b* from those of the runner 16*a*, 16*b*.

The cooperation of the operation lever 26 with the lock 14 is done due to cooperation means constituted by the cooperation of two internal side projections 33*a*, 33*b* with the back end part 25 of the lock 14. Note that the two internal side projections 33*a*, 33*b* of the operation lever 26 are situated between the pivotal axle 27 of the transverse branch of prehension 29. Furthermore, these two projections are extended on towards the other, that is to say in the direction of the plane of symmetry (P). One will note that the back end part 25 is engaged in the interior of the stirrup 26 between the two sides 28*a*, 28*b* and is situated above the two activating projections 33*a*, 33*b*. The means of cooperation 33*a*, 33*b* specifies a point of cooperation 330 with the lock 14 which corresponds to the point of contact of the projections 33 with the lock 14 and, more particularly, its back end part 25.

On this subject, one will note that the distance (D1) between the point of cooperation 330 and the pivotal axle 27 of the operation lever 26 is less than the distance (D2) between the point of prehension 290 and the same pivotal axle 27, as can be seen, more particularly in FIG. 3.

Advantageously, the distance (D2) is equal to at least two times the distance (D1). Furthermore, the distance (D3) between the point of cooperation 330 of the pivotal center 41 of the lock 14 is more than the distance (D1) and advantageously more than the distance (D2). Additionally, the pivotal axle 27 and the point of cooperation 330 are situated approximately at the level of the horizontal surface (H1) going through the pivotal axle 41 of the lock 14.

One will understand that, due to the differences of the arms of the lever, the user will be able to raise the lock without having to use significant pressure and, in so doing, without the risk of untimely unlocking.

The lock 14 extends from its front end 20 towards the rear to its back end part 25, and is approximately at the horizontal surface (H1) going through the pivotal center 41 of the said lock 14. Advantageously, the surface (H2) of the central part 34 of the lock 14 is situated slightly underneath the horizontal surface (H1), while the surface (H3) of the back end part 25 is also situated slightly underneath the horizontal surface (H1).

According to a characteristic of the invention, the pivotal axle 27 of the operation lever 26 is situated in the lower part 36 of the body 2 of the binding and more particularly at the back 42 of the lower part 36. By lower part 36, one understands it to be the part of the body 2 located under the horizontal surface (H4) of the elastic system 5. Additionally, the elastic system 7 is housed in a central housing 70 which is achieved in the body 2, while adjustment means of the prestressed concrete of the spring 7 is anticipated, which includes an adjustment screw 71 with a nut 72.

Figure 9:
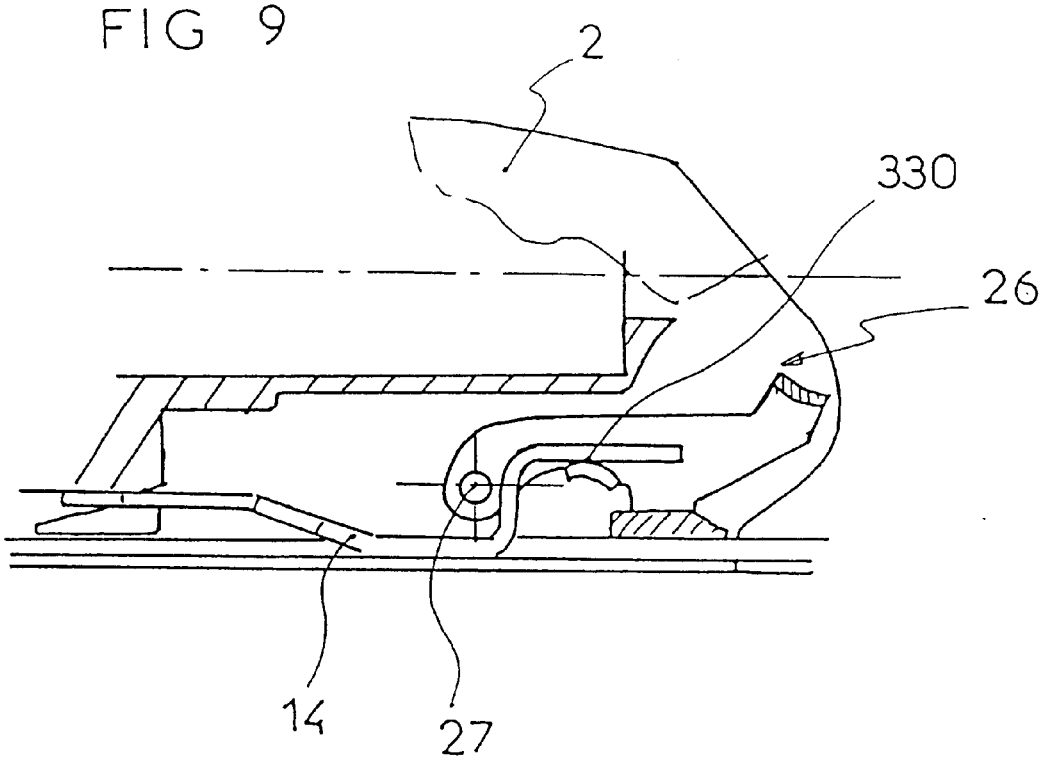
FIGS. 9 and 10 are views illustrating two variations of the operation.
Figure 10:
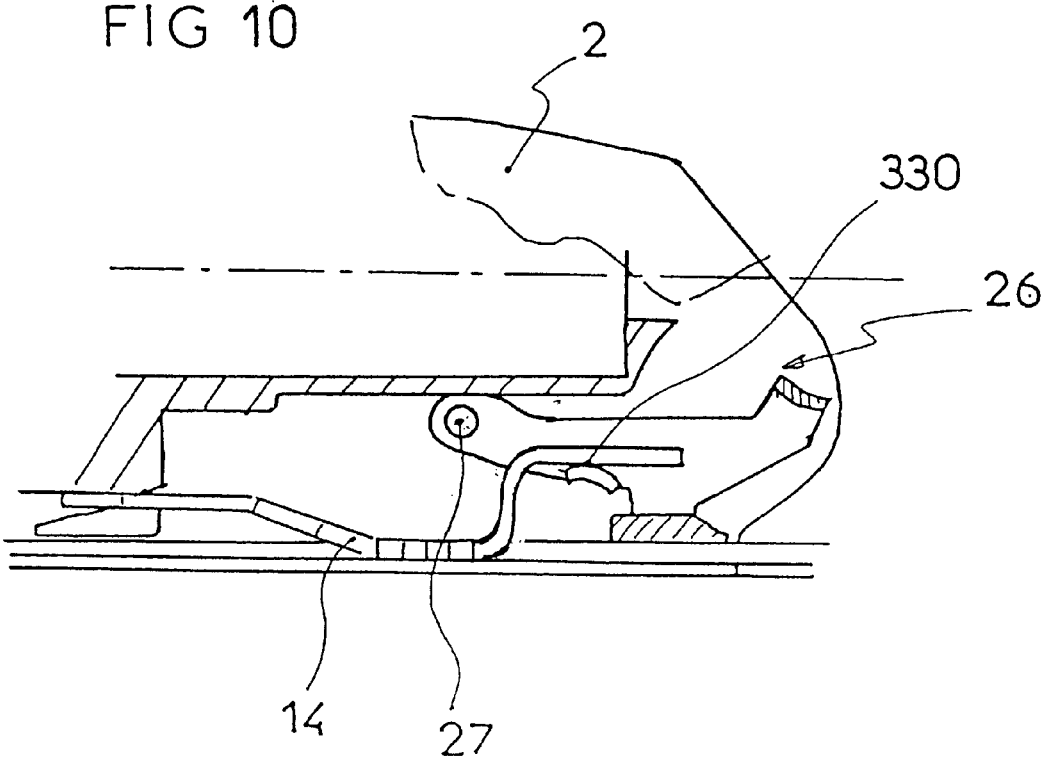

FIGS. 9 and 10 illustrate two variations of operation according to which the pivotal axle 27 of the operation lever is located above the lock 14, the axle 27 being situated higher in the achievement of FIG. 10 than in that of FIG. 9. Advantageously, the pivotal axle 27 is situated under the area 70 occupied by the elastic system 5.

One will note that the pivotal axle 27 of the operation lever 26 is situated in the preferred method of achievement shown in FIGS. 1 through 8 under the lock 14 and more particularly under its back end part 25. The axle 27 is, moreover, situated just behind the vertical part 24 of the lock 14, approximately at the level of the horizontal surface (H1) going through the pivotal axle 41 of the said lock 14 and, advantageously, slightly above the said surface (H1).

One will clarify that the operation lever 26 is advantageously a lever of the second type, that is to say a lever in which the resistance is between the point of rest and force. In effect, the point of cooperation 330 is situated between the pivotal axle 27 constituting the point of rest and the point of prehension 290 constituting the point of force. Additionally, the housing 32 is closed at least partially at the top by a transverse upper wall 325, the said wall limiting the pivot of the operation lever 26 towards the top.

In the achievement given as example, the lock 14 includes many teeth 15*a*, 15*b* but it could only include a single tooth 15. It includes therefore at least one tooth 15. Let's also clarify that the teeth 16*a*, 16*b*) are achieved in a central port which is achieved in the runner.

It is well understood, the invention is not limited to the methods of achievement described and represented as examples, but also includes all equivalent techniques as well as their combinations.

We claim:

1. A binding for a ski whose longitudinal position in relation to the ski is adjustable, including:

a movable body slidably mounted on a runner which is fixed to the ski;

a locking means which permits a user to lock the moveable body at a selected longitudinal position along the ski, the locking means including:

a lock movable from a locked position to an unlocked position, the lock cooperating with an operation lever which is separate from and in a detached relationship to the lock and the operation lever cooperating with a back end part of the lock such that an upthrust of the operation lever causes movement of the lock from the locked position to the unlocked position, and such that the operation lever is extended towards a back portion of the binding in a hollow housing located in a back area of the body.

2. The binding for a ski according to claim 1, wherein the operation lever is a lever of a second type in which the operation lever has a gripping portion at a rear end of the lever, a pivot axis at a front end of the lever, and a point of cooperation between the gripping Portion and the pivot axis which engages the back end port of the lock.

3. The binding for a ski according to claim 1, wherein the hollow housing is open at the back portion and is laterally limited by two side walls of the body, a depth of the hollow housing being such that a branch of the operation lever is contained within the back area of the body so that it is totally protected inside the hollow housing, at least in its locked position.

4. The binding for a ski according to claim 3, wherein the hollow housing is such that the operation lever is also protected by side walls in its unlocked position.

5. The binding for a ski according to claim 1, wherein the operation lever has a pivotal axis situated approximately at a level of a horizontal surface going through a pivotal axis of the lock.

6. The binding for a ski according to claim 5, wherein the pivotal axis of the operation lever is situated slightly above the horizontal surface.

7. The binding for a ski according to claim 1, wherein the operation lever cooperates with a back end part of the lock.

8. The binding for a ski according to claim 7, wherein the lock includes:

a metal section which includes a front end;

a back end folded at the top by a vertical part which extends the back end part and is folded approximately horizontally to the back.

9. The binding for a ski according to claim 8, wherein a central part of the lock includes a series of lateral teeth and the runner includes a series of corresponding teeth.

10. The binding for a ski according to claim 9, wherein the lock includes at least one tooth cooperating with a series of corresponding teeth which are defined in the runner.

11. The binding for a ski according to claim 10, wherein the lock includes a series of lateral teeth.

12. The binding for a ski according to claim 1, wherein the lock is urged into locked position by a resilient biasing system.

13. A binding for a ski whose longitudinal position in relation to the ski is adjustable, the binding including:

a movable body slidably mounted on a runner which is fixed to a ski;

a pivotal lock element pivotal between an unlocked position which permits the user to move the body longitudinally along the ski and a locked position which fixes a longitudinal position of the body along the ski;

an operation lever detached from the lock element, which cooperates with the lock element, and is pivotally mounted on the body of the binding around a pivotal axle which axle is situated in a lower part of the body of the binding, the operation lever cooperating with the lock element such that the upthrust of the operation lever causes movement of the lock element from its locked position to its unlocked position.

14. The binding for a ski according to claim 13, wherein the pivotal axle of the operation lever is situated under a horizontal surface of a resilient element.

15. The binding for a ski according to claim 13, wherein the pivotal axle of the operation lever is situated under the lock element.

16. The binding for a ski according to claim 15, wherein the pivotal axle of the operation lever is situated under a back end part of the lock element.

17. A binding for a ski whose longitudinal position in relation to the ski is adjustable, the binding including:

a movable body slidably mounted alone a ski;

a locking means which permits the user to lock the said body in a selected longitudinal Position along the ski, the locking means including:

a lock element movable from a locked position to an unlocked position, an operation lever detached from the lock element and cooperating with the lock element such that an upthrust of the operation lever as it Divots about a pivotal axis causes the movement of the lock element from its locked position to its unlocked position, the operation lever engaging the locking element at a point of cooperation such that a distance between the point of cooperation and the pivotal axis of the operation lever is less than a distance between a point of prehension and the pivotal axis, the operation lever being disposed in a hollow which is defined in the back part of the body with the point of prehension adjacent the back part of the body.

18. The binding for a ski according to claim 17, wherein the pivotal axis of the operation lever and the point of cooperation are situated at a level of a horizontal surface going through the pivotal axis of the lock element.

19. A binding for a ski whose longitudinal position in relation to the ski is adjustable, including:

a movable body slidably mounted on a runner which is fixed to a ski;

a locking means which permits the user to lock the said body in a selected longitudinal position, the locking means including:

a lock movable from a locked position to an unlocked position, a pivoting operation lever detached from the lock and cooperating with the lock such that a pivotal upthrust of the operation lever causes movement of the lock from its locked position to its unlocked position, the pivoting operation lever including a metal stirrup in the shape of a "U" open at the bottom including two lateral sides connected by their back ends by a transverse branch, the pivoting operation lever being disposed in a hollow with the branch of prehension toward a back part of the body.

20. The binding for a ski according to claim 19, wherein the lateral sides extend approximately horizontally from a jointed part to the transverse branch.

* * * * *